US011074883B2

(12) United States Patent
Li et al.

(10) Patent No.: US 11,074,883 B2
(45) Date of Patent: Jul. 27, 2021

(54) PIXEL CIRCUIT HAVING LATCH SUB-CIRCUIT AND LATCH-CONTROL SUB-CIRCUITS, DISPLAY PANEL, DRIVING METHOD THEREOF, AND A DISPLAY APPARATUS

(71) Applicants: Ordos Yuansheng Optoelectronics Co., Ltd., Inner Mongolia (CN); BOE Technology Group Co., Ltd., Beijing (CN)

(72) Inventors: Fuqiang Li, Beijing (CN); Jun Fan, Beijing (CN)

(73) Assignees: Ordos Yuansheng Optoelectronics Co., Ltd., Inner Mongolia (CN); BOE Technology Group Co., Ltd., Beijing (CN)

( * ) Notice: Subject to any disclaimer, the term of this patent is extended or adjusted under 35 U.S.C. 154(b) by 14 days.

(21) Appl. No.: 16/616,956

(22) PCT Filed: Dec. 13, 2017

(86) PCT No.: PCT/CN2017/115913
§ 371 (c)(1),
(2) Date: Nov. 25, 2019

(87) PCT Pub. No.: WO2019/033641
PCT Pub. Date: Feb. 21, 2019

(65) Prior Publication Data

US 2020/0152152 A1 May 14, 2020

(30) Foreign Application Priority Data

Aug. 14, 2017 (CN) ..... 201710692677.X

(51) Int. Cl.
*G09G 3/36* (2006.01)

(52) U.S. Cl.
CPC ..... *G09G 3/3677* (2013.01); *G09G 3/3688* (2013.01); *G09G 2300/0819* (2013.01);
(Continued)

(58) Field of Classification Search
CPC ..... G09G 3/3677; G09G 3/3688; G09G 2300/0819; G09G 2300/0842; G09G 2310/0278; G09G 2330/021
See application file for complete search history.

(56) References Cited

U.S. PATENT DOCUMENTS

2003/0142054 A1 7/2003 Tada
2006/0221033 A1 10/2006 Yasuda et al.
(Continued)

FOREIGN PATENT DOCUMENTS

CN 1437183 A 8/2003
CN 1847936 A 10/2006
(Continued)

OTHER PUBLICATIONS

International Search Report & Written Opinion dated May 4, 2018, regarding PCT/CN2017/115913.

*Primary Examiner* — Lisa S Landis
(74) *Attorney, Agent, or Firm* — Intellectual Valley Law, P.C.

(57) ABSTRACT

The present application discloses a pixel circuit of a display panel. The pixel circuit includes a first latch-control sub-circuit configured to provide a data signal under controls of a first scan signal, a latch sub-circuit including a first inverter having an input terminal coupled to receive the data signal and a second inverter, a second latch-control sub-circuit configured to disconnect the second inverter from the first inverter to form an open circuit under controls of the first scan signal or form a latch loop under controls of a second scan signal to stabilize two voltage levels at the first output
(Continued)

terminal of the first inverter and the second output terminal of the second output inverter, and an output sub-circuit configured to switch connection between an output terminal and two reference voltage ports under controls of the two voltage levels alternatively.

18 Claims, 3 Drawing Sheets

(52) U.S. Cl.
CPC ..... *G09G 2300/0842* (2013.01); *G09G 2310/0278* (2013.01); *G09G 2330/021* (2013.01)

(56) References Cited

U.S. PATENT DOCUMENTS

| | | | | |
|---|---|---|---|---|
| 2008/0174538 | A1* | 7/2008 | Yasuda ..... | G09G 3/3648 345/98 |
| 2008/0303762 | A1 | 12/2008 | Yasuda et al. | |

FOREIGN PATENT DOCUMENTS

| | | | |
|---|---|---|---|
| CN | 101320537 | A | 12/2008 |
| CN | 101393775 | A | 3/2009 |
| JP | 2004354741 | A | 12/2004 |

* cited by examiner

PIXEL CIRCUIT HAVING LATCH SUB-CIRCUIT AND LATCH-CONTROL SUB-CIRCUITS, DISPLAY PANEL, DRIVING METHOD THEREOF, AND A DISPLAY APPARATUS

CROSS-REFERENCE TO RELATED APPLICATION

This application is a national stage application under 35 U.S.C. § 371 of International Application No. PCT/CN2017/115913 filed Dec. 13, 2017, which claims priority to Chinese Patent Application No. 201710692677.X, filed Aug. 14, 2017, the contents of which are incorporated by reference in the entirety.

TECHNICAL FIELD

The present invention relates to display technology, more particularly, to a pixel circuit, a display panel, and a method for driving a display panel to display image, a display apparatus thereof.

BACKGROUND

Liquid crystal display panel includes multiple gate lines in and multiple data lines overlapping in an array layout to define multiple subpixels in the display panel. Each subpixel is configured with at least a switch transistor, a common electrode, and a pixel electrode. For each row of subpixels, a gate terminal of the switch transistor of each subpixel is connected to a same gate line. For each column of subpixels, a drain terminal of the switch transistor of each subpixel is connected to a pixel electrode thereof. A liquid crystal capacitor is formed for each subpixel between the common electrode and the pixel electrode.

When the liquid crystal display panel is operated for displaying image, a scan signal is provided from gate driver to the multiple gate lines. The scan signal can be categorized by a first scan signal and a second scan signal, one of which is a high-voltage signal while the other is a low-voltage signal. When the gate terminal of the switch transistor receives a first scan signal and is switched on, the data line is electrically connected to the pixel electrode for charging the liquid crystal capacitor with a data signal at a high voltage level. When the gate terminal of the switch transistor receives the second scan signal and is switched off, the high voltage of the data signal stored in the liquid crystal capacitor is used to maintain the deflection state of liquid crystal molecules. But leakage current leads to reduction of the charges in the liquid crystal capacitor and decay of voltage difference across two terminals of the liquid crystal capacitor. For displaying one frame of image, the charges of the liquid crystal display panel needs to be refreshed by regularly applying the scan signals in a fixed cycle time, thereby increasing power consumption of the display panel.

SUMMARY

In an aspect, the present disclosure provides a pixel circuit. The pixel circuit includes a first latch-control sub-circuit including a first latch-control terminal coupled to a scan signal port and an input terminal coupled to a data signal port. The first latch-control sub-circuit is configured to output the data signal when the scan signal port receives a first scan signal at a first voltage level. The pixel circuit further includes a latch sub-circuit coupled to the first latch-control sub-circuit and includes a first inverter and a second inverter. The first inverter has an input terminal configured to receive the data signal and coupled to the second inverter to form a latch loop when the scan signal port receives a second scan signal at a second voltage level. Each of the first inverter and the second inverter inverts the first voltage level to the second voltage level and vice versa. Additionally, the pixel circuit includes a second latch-control sub-circuit coupled to the latch sub-circuit. The second latch-control sub-circuit includes a second latch-control terminal and is configured to control that the second inverter and the first inverter form an open circuit when the scan signal port receive the first scan signal at the first voltage level. Furthermore, the pixel circuit includes an output sub-circuit including a first control terminal coupled to a first output terminal of the first inverter, a second control terminal coupled to a second output terminal of the second inverter, a first input terminal coupled to a first reference voltage port, a second input terminal coupled to a second reference voltage port, and an output terminal coupled to a pixel electrode. The output sub-circuit is configured to connect the output terminal with the first input terminal when the first control terminal is set to the first voltage level and connect the output terminal with the second input terminal when the second control terminal is set to the first voltage level.

Optionally, the first latch-control sub-circuit includes a first switch transistor having a gate terminal coupled to the first latch-control terminal, a first terminal coupled to the data signal port, and a second terminal coupled to the input terminal of the first inverter. The first switch transistor is configured to connect the first terminal to the second terminal when the gate terminal receives the first scan signal at the first voltage level from the first latch-control terminal coupled to the scan signal port.

Optionally, the first-voltage level of the first scan signal is a switch-on signal. The first switch transistor is an N-type transistor if the first voltage level is a high voltage level or a P-type transistor if the first voltage level is a low voltage level.

Optionally, the second latch-control sub-circuit includes a second switch transistor having a gate terminal coupled to the second latch-control terminal, a first terminal coupled to the second terminal of the first switch transistor, and a second terminal coupled to the second output terminal of the second inverter. The second switch transistor is configured to connect the first terminal thereof to the second terminal thereof when the gate terminal thereof receives a second scan signal at the second voltage level from the second latch-control terminal.

Optionally, the second latch-control terminal is coupled to the scan signal port shared with the first latch-control terminal. The second voltage level of the second scan signal is a switch-on signal for the second switch transistor but a switch-off signal for the first switch transistor.

Optionally, the second switch transistor is a P-type transistor and the first switch transistor is an N-type transistor if the second voltage level is a low-voltage level or the second switch transistor is an N-type transistor and the first switch transistor is a P-type transistor if the second voltage level is a high voltage level.

Optionally, the second latch-control sub-circuit includes a third switch transistor having a gate terminal coupled to a third latch-control terminal, a first terminal coupled to the first output terminal of the first inverter, and a second terminal coupled to an input terminal of the second inverter. The third switch transistor is configured to connect the first terminal to the second terminal when the gate terminal receives the second scan signal at the second voltage level from the third latch-control terminal.

Optionally, the third latch-control terminal is coupled to the scan signal port shared with the first latch-control terminal. The second voltage level of the second scan signal is a switch-on signal for the third switch transistor but a switch-off signal for the first switch transistor.

Optionally, the third switch transistor is, a P-type transistor if the second voltage level is a low-voltage level while the first voltage level is a high voltage level, or an N-type transistor if the second voltage level is a high voltage level while the first voltage level is a low voltage level.

Optionally, the second latch-control sub-circuit includes a second switch transistor and a third switch transistor. The second switch transistor includes a gate terminal coupled to a second latch-control terminal, a first terminal connected to the second terminal of the first switch transistor, and a second terminal connected to the second output terminal of the second inverter. The third switch transistor includes a gate terminal also coupled to a third latch-control terminal, a first terminal connected to the first output terminal of the first inverter, and a second terminal connected to an input terminal of the second inverter.

Optionally, the second latch-control terminal and the third latch-control terminal is commonly coupled to the scan signal port to receive the second scan signal at the second voltage level as a switch-on signal to turn on the second switch transistor for connecting the first terminal to the second terminal thereof and simultaneously turn on the third switch transistor for connecting the first terminal to the second terminal thereof to connect the first inverter end-to-end to the second inverter as a latch loop, or to receive the first scan signal at the first voltage level as a switch-off signal to turn off both the second switch transistor and the third switch transistor to have the first inverter and the second inverter forming an open circuit.

Optionally, each of the second switch transistor and the third switch transistor is a P-type transistor while the first switch transistor is an N-type transistor if the second voltage level is a low voltage level corresponding to the first voltage level at a high voltage level.

Optionally, each of the second switch transistor and the third switch transistor is an N-type transistor while the first switch transistor is a P-type transistor if the second voltage level is a high voltage level corresponding to the first voltage level at a low voltage level.

Optionally, the output sub-circuit includes a first output transistor and a second output transistor. The first output transistor includes a first terminal coupled to the first input terminal received a first reference voltage from the reference voltage port, a second terminal coupled to the output terminal, and a gate terminal coupled to the first control terminal. The second output transistor includes a first terminal coupled to the second input terminal received a second reference voltage from the second reference voltage port, a second terminal coupled to the output terminal, and a gate terminal coupled to the second control terminal.

Optionally, the first output transistor is configured to connect the first terminal to the second terminal thereof to output the first reference voltage to the output terminal when the first control terminal receives the first voltage level from the first output terminal of the first inverter. The second output transistor is configured to connect the first terminal to the second terminal thereof to output the second reference voltage to the output terminal when the second control terminal receives the first voltage level voltage level from the second output terminal of the second inverter.

Optionally, each of the first output transistor and the second output transistor is the same type of transistor as the first switch transistor as the first voltage level is set to a switch-on signal for the first switch transistor and the second voltage level is a voltage level inverted by one of the first inverter and the second inverter from the first voltage level.

In another aspect, the present disclosure provides a display panel including multiple gate lines and multiple data lines interlaced over each other defining multiple subpixels. Each subpixel comprises a pixel circuit described herein for providing driving electric field. The scan signal port of the pixel circuit is connected to corresponding one of the multiple gate lines and the data signal port is connected to corresponding one of the multiple data lines.

In yet another aspect, the present disclosure provides a display apparatus including a display panel described herein.

In still another aspect, the present disclosure provides a method of driving the display panel described herein. The method includes, in each driving cycle, sequentially providing a first scan signal at a first voltage level to each of the multiple gate lines of the display panel. Each of the multiple gate lines is configured to receive the first scan signal for a number of times that is smaller than a preset number of scans. The method further includes providing a second scan signal at a second voltage level when the each of the multiple gate lines does not receive the first scan signal. Additionally, the method includes providing data signals respectively to the multiple data lines.

Optionally, each of the multiple gate lines receives the first scan signal once in each driving cycle.

Optionally, wherein the first voltage level is set as a high voltage configured to turn on an N-type transistor and the second voltage level is set as a low voltage configured to turn on a P-type transistor.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

A technical problem for liquid crystal display panel is to reduce its power consumption. Accordingly, the present disclosure provides, inter alia, a pixel circuit, a display panel and a driving method thereof, and a display apparatus having the same that substantially obviate one or more of the problems due to limitations and disadvantages of the related art.

Figure 1:
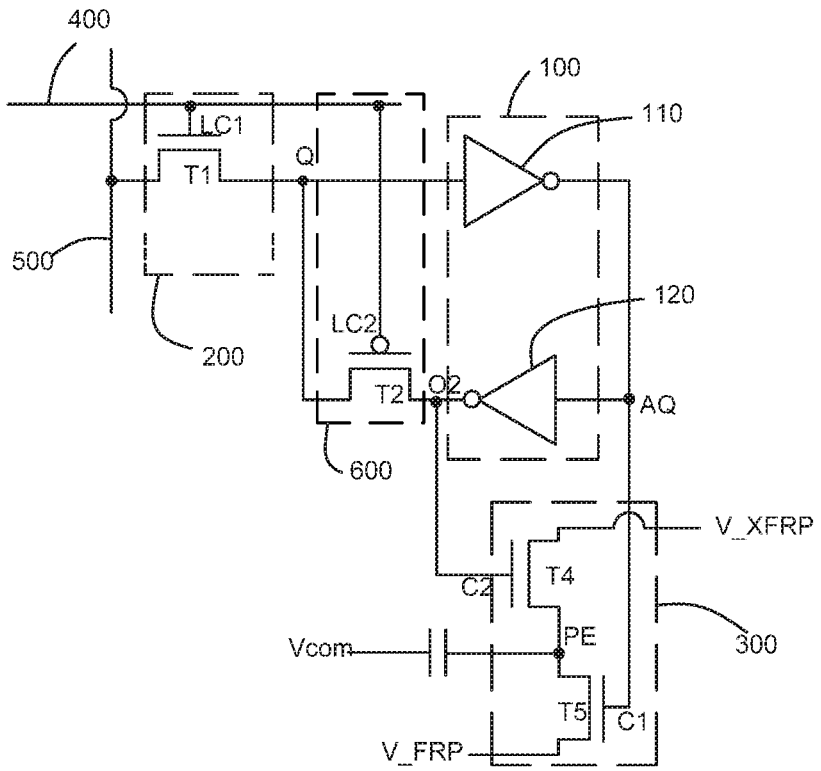
FIG. 1 is a circuitry structural diagram of a pixel circuit according to an embodiment of the present disclosure.

In an aspect, the present disclosure provides a pixel circuit. As shown in FIG. 1, a circuitry diagram of the pixel circuit is provided, including a first latch-control sub-circuit 200. The first latch-control sub-circuit includes a first latch-control terminal LC1 coupled to a scan signal port 400 and an input terminal coupled to a data signal port 500. The scan signal port 400 is coupled to a scan line configured to input at least a first scan signal at a first voltage level and a second scan signal at a second voltage level. The data signal port 500 is coupled to a data line configured to input at least a first data signal at the first voltage level and a second data signal at the second voltage level. The first latch-control sub-circuit 200 is configured to output a data signal when the first latch-control terminal LC1 coupled to the scan signal port 400 receives a first scan signal at a first voltage level. Optionally, the first voltage level is a high voltage level and the second voltage level is a low voltage level. Optionally, the first voltage level is a low voltage level while the second voltage level is a high voltage level.

Referring to FIG. 1, the pixel circuit further includes a latch sub-circuit 100 including a first inverter 110 and a second inverter 120. The first inverter 110 has an input terminal Q configured to receive a data signal originally from the data signal port 500 outputted by the first latch-control sub-circuit 200 when the first scan signal is inputted through the scan signal port 400. The second inverter 120 is configured to have an input terminal coupled with a first output terminal AQ of the first inverter 110 and a second output terminal O2 coupled to the input terminal Q of the first inverter 110 to form a latch loop when the scan signal port 400 receives the second scan signal at the second voltage level. Each of the first inverter 110 and the second inverter 120 is configured to change a high voltage signal at its input terminal to a low voltage signal at its output terminal or vice versa.

Furthermore, the pixel circuit includes a second latch-control sub-circuit 600 coupled to the latch sub-circuit 100 and the first latch-control sub-circuit 200. The second latch-control sub-circuit 600 includes an input terminal coupled to the second output terminal O2 of the second inverter 120 and an output terminal coupled to the input terminal Q of the first inverter 110 (which is also the output terminal of the first latch-control sub-circuit 200). The second latch-control sub-circuit 600 includes a second latch-control terminal LC2 coupled to the scan signal port 400 to control that the second inverter 120 and the first inverter 110 form an open circuit when the second latch-control terminal LC2 coupled to the scan signal port 400 receives the first scan signal at the first voltage level.

Referring to FIG. 1 again, the pixel circuit further includes an output sub-circuit 300 having a first control terminal coupled to the first output terminal AQ of the first inverter 110 and a second control terminal coupled to the second output terminal of the second inverter 120. The output sub-circuit 300 also includes a first input terminal coupled to a first reference voltage port FRP, a second input terminal coupled to a second reference voltage port XFRP, and an output terminal coupled to a pixel electrode PE. The first reference voltage port FRP is configured to be supplied with a first reference voltage V_FRP and the second reference voltage port XFRP is configured to be supplied with a second reference voltage V_XFRP. The output sub-circuit 300 is configured to connect the output terminal with the first input terminal when the first control terminal is set to the first voltage level and connect the output terminal with the second input terminal when the second control terminal is set to the first voltage level.

When the second latch-control terminal LC2 couples to the scan signal port 400 to receive the second scan signal at the second voltage level, the second latch-control sub-circuit 600) controls to disconnect the input terminal Q of the first inverter 110 from the data signal port 500 and controls the first inverter 110 and the second inverter 120 to form a latch loop in which the first output terminal AQ of the first inverter 110 is electrically connected to an input terminal of the second inverter 120 and the second output terminal O2 of the second inverter 120 is electrically connected to the input terminal Q of the first inverter 110.

When the pixel circuit is applied to a (liquid crystal) display panel, the scan signal port 400 is connected to a corresponding scan line and the data signal port 500 is connected to a corresponding data line. A source driving circuit is used to provide data signals to respective data lines and pass to the data signal port 500 of the pixel circuit. A gate driving circuit is used to provide scan signals to scan through respective gate lines and pass to the scan signal port 400 of the pixel circuit. Optionally, for displaying one frame of image, the first scan signal has a first duration at a high voltage level and a second duration at a low voltage level and the first duration is smaller than the second duration. At a beginning of each cycle of displaying one frame of image, the first scan signal is provided firstly and the second scan signal is provided in remaining time of the each cycle. Optionally, the first reference voltage V_FRP is provided to be the same as the second data signal at the second voltage level and the second reference voltage V_XFRP is provided to be the same as the first data signal at the first voltage level. Of course, the present invention does not limit the optional values for the first reference voltage and the second voltage. In fact, the first reference voltage V_FRP can be provided to be the first voltage level and the second reference voltage V_XFRP can be provided to be the second voltage level. Optionally, the first reference voltage and the second reference voltage can be set to any other values depended on requirement for displaying a specific image.

In an example, the pixel circuit of FIG. 1 can be operated when the data signal port 500 inputs a first data signal set at the first voltage level. Referring to FIG. 1, when the gate line provides a first scan signal to the scan signal port 400, the first latch-control terminal LC1 coupled to the scan signal port 400 receives the first scan signal at the first voltage level so that the first latch-control sub-circuit 200 is configured to connect its input terminal, which connects to the data signal port 500, to its output terminal, which connects to the input terminal Q of the first inverter 110, and the second latch-control sub-circuit 600 is configured to disconnect its input terminal, which connects to the second output terminal O2 of the second inverter 120, to its output terminal, which connects to the input terminal Q of the first inverter 110. The first data signal at the first voltage level provided via the data signal port 500 from the data line then is written into the input terminal Q of the first inverter 110. The first inverter 110 is able to convert the first data signal of the first voltage level at the input terminal Q to the second voltage level at the output terminal AQ which is the same as the second data signal at the second voltage level. Further, this second voltage level is outputted to the first control terminal C1 of the output sub-circuit 300 and is able to cause the first input terminal of the output sub-circuit 300 to disconnect with the output terminal of the output sub-circuit 300. At this time, the second voltage level is also inputted to the input terminal of the second inverter 120 and is inverted to the first voltage level again at the output terminal O2 of the second inverter 120. At the same time, the second control terminal LC2 of the second latch-control sub-circuit 600 is also coupled to the scan signal port 400 to receive the first scan signal at the first voltage level which controls the second latch-control sub-circuit 600 to disconnect its input terminal to its output terminal so that the first inverter 110 and the second inverter 120 of the latch sub-circuit 100 forms an open circuit. The second control terminal C2 of the output sub-circuit 300 is connected to the output terminal O2 of the second inverter 120 to receive the signal at the first voltage level, but not connected to the input terminal Q of the first inverter 110 to compete for the voltage signal. Thus, the second input terminal of the output sub-circuit 300, which connects to the second reference voltage port XFRP, is able to stably connect with the output terminal of the output sub-circuit 300, which is connected to the pixel electrode PE. Therefore, the second reference voltage V_XFRP supplied to the second reference voltage port XFRP can be stably applied to the pixel electrode PE.

Referring to FIG. 1, the second reference voltage V_XFRP is set to be the same as the first data signal at the first voltage level. Optionally, the first voltage level is above the voltage level Vcom provided at a common electrode COM. Thus, a capacitance between the pixel electrode PE and the common electrode COM is able to induce an electrical field to drive defections of liquid crystal molecules (for displaying image).

Within a same cycle of displaying one frame of image, when the gate line provides a second scan signal at the second voltage level to the scan signal port 400, the first latch-control terminal LC1 coupled to the scan signal port 400 receives the second scan signal at the second voltage level so that the first latch-control sub-circuit 200 is controlled to disconnect the input terminal Q of the first inverter 110 from the data signal port 500. At the same time, the second latch-control terminal LC2 coupled to the same scan signal port 400 receives the same second scan signal at the second voltage level so that the second latch-control sub-circuit 600 is controlled to connect the output terminal AQ of the first inverter 110 with the input terminal of the second inverter 120 to form a latch loop in the latch sub-circuit 100. At this time, the output of the first inverter 110 becomes a voltage signal supplied to the first control terminal C1 of the output sub-circuit 300, which is at the second voltage level. At the same time the output of the first inverter 110 is also an input of the second inverter 120. After inversion of the second inverter 120 the voltage signal at the second voltage level is inverted to a voltage signal at the first voltage level at the second output terminal O2. This voltage signal then is inputted again to the input terminal Q of the first inverter 110. Since the second control terminal C2 of the output sub-circuit 300 is connected to the second output terminal O2 of the second inverter 120 so that the second control terminal C2 is set to the first voltage level. In general, the first inverter 110 and the second inverter 120 are connected end-to-end through the second latch-control sub-circuit 600 to form a latch loop, thereby latching the voltage signal at the first voltage level at the input terminal Q of the first inverter 110. Since the second control terminal C2 of the output sub-circuit 300 is set to the first voltage level, the second input terminal of the output sub-circuit 300 is connected to the output terminal of the output sub-circuit 300 to have the second reference voltage V_XFRP been written into the pixel electrode PE. Within the time of displaying one frame of image, no refreshment of the scan signal supply is needed. Therefore, power consumption of the display panel is reduced.

Alternatively, when the data signal received by the data signal port 500 is a second data signal at the second voltage level (or a low voltage level for example). The pixel circuit disclosed above can be operated as following scheme. When the gate line provides a first scan signal at the first voltage level to the scan signal port 400, the first latch-control terminal LC1 couples to the scan signal port 400 to receive the first scan signal at the first voltage level so that first latch-control sub-circuit 200 is configured to connect its input terminal (which connects to the data signal port 500) to its output terminal to write the second data signal at the second voltage level into the input terminal Q of the first inverter 110. At the same time, the second latch-control terminal LC2 also couples to the scan signal port 400 to receive the same first scan signal at the first voltage level so that the second latch-control sub-circuit 600 is configured to disconnect the second output terminal O2 of the second inverter 120 from the input terminal Q of the first inverter 110 to form an open circuit in the latch sub-circuit 100. After inversion of the first inverter 110, the second data signal at the second voltage level is inverted to a voltage signal at the first voltage level at the output terminal AQ of the first inverter 110, which is further outputted to the first control terminal C1 of the output sub-circuit 300. The voltage signal at the first voltage level set to the first control terminal C1 makes the first input terminal of the output sub-circuit 300 to electrically connect to the output terminal of the output sub-circuit 300 which connects to the pixel electrode PE. Thus, the first reference voltage V_FRP provided through the first reference voltage port FRP coupled to the first input terminal, which is set to be the same as the second data signal at the second voltage level, can be applied to the pixel electrode PE.

In the example, the voltage signal at the first voltage level at the first output terminal AQ of the first inverter 110 is also inputted to the input terminal of the second inverter 120 which further inverts it to a voltage signal at the second voltage level at the second output terminal O2. Since the second control terminal C2 of the output sub-circuit 300 is connected to the second output terminal O2 of the second inverter 120 to receive the voltage signal at the second voltage level, the second input terminal of the output sub-circuit 300 is disconnected from the output terminal of the output sub-circuit 300. In other words, the output terminal only receives first reference voltage V_FRP via the first input terminal from the first reference voltage port FRP.

Within a same cycle of displaying one frame of image, when the gate line provides a second scan signal at the second voltage level to the scan signal port 400, the first latch-control terminal LC1 coupled to the scan signal port 400 receives the second scan signal at the second voltage level so that the first latch-control sub-circuit 200 is controlled to disconnect the input terminal Q of the first inverter 110 from the data signal port 500. At the same time, the second latch-control terminal LC2 also couples to the scan signal port 400 to receive the second scan signal at the second voltage level so that the second latch-control sub-circuit 600 is controlled to connect the second output terminal O2 of the second inverter 120 with the input terminal Q of the first inverter 110. At this time, the first inverter 110 and the second inverter 120 form a closed latch loop in a latch sub-circuit 100. The voltage level at the input terminal Q of the first inverter 110 is the second voltage level and voltage level at the first output terminal AQ of the first inverter 110 is the first voltage level. The first control terminal C1 of the output sub-circuit 300 is thus set to the first voltage level. The end-to-end closed latch loop between the first inverter 110 and the second inverter 120 is able to latch the second voltage level at the input terminal Q of the first inverter 110. The voltage signal at the first voltage level applied to the first control terminal C1 of the output sub-circuit 300 is able to ensure that the first reference voltage V_FRP (being set to the same level as the second data signal) is applied to the pixel electrode PE. Therefore, there is no need to refresh the scan signal within the cycle and the power consumption is reduced for driving the display panel to display image.

Within the cycle, when the gate line provides a scan signal at the first voltage level, the first inverter 110 and the second inverter 120 of the latch sub-circuit 100 form an open circuit. The first control terminal C1 of the output sub-circuit 300 will thus receive a stable voltage signal at the first voltage level. Therefore, the connection between the first input terminal of the output sub-circuit 300 and the output terminal of the output sub-circuit 300 can be stably maintained.

In an embodiment of the present disclosure, the first latch-control sub-circuit 200 includes a first switch transistor T1 having a gate terminal coupled to the first latch-control terminal LC1, a first terminal coupled to the data signal port 500, and a second terminal coupled to the input terminal Q of the first inverter 110. The first switch transistor T1 is configured to connect the first terminal to the second terminal when the gate terminal receives the first scan signal at the first voltage level from the first latch-control terminal LC1 coupled to the scan signal port 400. Optionally, the first switch transistor is an N-type transistor in case that the first voltage level is set to a high voltage level as a switch-on signal. Optionally, the first switch transistor is a P-type transistor in case that the first voltage level is set to a low voltage level as a switch-on signal.

In the embodiment, The second latch-control sub-circuit 600 can be provided in several embodiments in terms of specific circuitry structure. In an embodiment, the second latch-control sub-circuit 600 provided in a circuit shown in FIG. 1 includes a second switch transistor T2 having a gate terminal coupled to the second latch-control terminal LC2, a first terminal coupled to the second terminal of the first switch transistor T1, and a second terminal coupled to the second output terminal O2 of the second inverter 120. The second switch transistor T2 is configured to connect the first terminal to the second terminal thereof when the gate terminal thereof receives a second scan signal at the second voltage level from the second latch-control terminal LC2. Optionally, the second latch-control terminal LC2 is commonly coupled to the scan signal port 400 shared with the first latch-control terminal LC1.

When the gate terminal of the first switch transistor T1 receives a first scan signal, the first terminal and the second terminal of the first switch transistor T1 are electrically connected to achieve the function of the first latch-control sub-circuit 200 for connecting the data signal port 500 with the input terminal Q of the first inverter 110 when the first latch-control terminal LC1 is coupled to the scan signal port to receive the first scan signal. Alternatively when the gate terminal of T1 receives a second scan signal, the first terminal is disconnected from the second terminal of T1 to achieve the function of the first latch-control sub-circuit 200 for disconnecting the input terminal Q of the first inverter 110 from the data signal port 500 when the first latch-control terminal LC1 receives the second scan signal.

Optionally, the first scan signal at the first voltage level is set to be a switch-on signal of the first switch transistor. The first switch transistor T1 is selected to be an N-type transistor if the first voltage level is a high voltage level or a P-type transistor if the first voltage level is a low voltage level. Accordingly, the second scan signal at the second voltage level is a switch-off signal for the first switch transistor.

In the embodiment shown in FIG. 1, the output sub-circuit 300 of the pixel circuit includes a first output transistor T5 and a second output transistor T4, and is configured to have its first control terminal C1 directly connected to the first output terminal of the first inverter 110 and the second control terminal C2 connected to the second output terminal of the second converter 120. The first output transistor T5 includes a first terminal coupled to the first reference voltage port FRP, a second terminal coupled to the output terminal which connects to a pixel electrode PE. The first output transistor T5 further includes a gate terminal being the first control terminal C1 coupled to the input terminal of the second inverter 120 or the first output terminal AQ of the first inverter 110. The second output transistor T4 includes a first terminal coupled to the second reference voltage port XFRP, a second terminal coupled to the output terminal commonly connects to the pixel electrode PE, and a gate terminal being the second control terminal C2 coupled to the second output terminal O2 of the second inverter 120. Optionally, each of the first output transistor T5 and the second output transistor T4 is an N-type transistor the same as the first switch transistor T1. If the first voltage level is set to the switch-on signal at a high voltage level for turning on the first switch transistor T1, the first output transistor T5 and the second output transistor T4 are also selected to be N-type transistors. If the second voltage level is set to the switch-on signal at a low voltage level for turning on the first switch transistor T1, the first output transistor T5 and the second output transistor T4 are also selected to be P-type transistors. In other words, the first output transistor T5 and the second output transistor T4 are the same type of transistor as the first switch transistor T1.

Referring to FIG. 1, the second switch transistor T2 of the second latch-control sub-circuit 600 includes a gate terminal coupled to the second latch-control terminal LC2 coupled to the scan signal port 400, a first terminal coupled to the second terminal of the first switch transistor T1 which connects to the input terminal Q of the first inverter 110, and a second terminal coupled to the second output terminal O2 of the second inverter 120. Optionally, the second switch transistor T2 is selected to be a P-type transistor while the first switch transistor T1 is an N-type transistor or the second switch transistor T2 is selected to be an N-type transistor while the first switch transistor T1 is a P-type transistor. Referring to FIG. 1, T1 is an N-type transistor and T2 is a P-type transistor. When the gate terminal of T2 receives the second scan signal (at the second voltage level), the first terminal of T2 is connected to the second terminal of T2, thereby connecting the second output terminal O2 of the second inverter 120 to the input terminal Q of the first inverter 110 to achieve the function of the second latch-control sub-circuit 600) to make the first inverter 110 and the second inverter 120 to form an end-to-end closed latch loop when the second latch-control terminal LC2 receives the second scan signal. When the gate terminal of T2 receives a first scan signal, the first terminal of T2 is disconnected from the second terminal of T2, thereby disconnecting the second output terminal O2 of the second inverter 120 from the input terminal Q of the first inverter 110 to achieve the function of the second latch-control sub-circuit 600 to make the first inverter 110 and the second inverter 120 to form an open circuit when the second latch-control terminal LC2 receives the first scan signal.

In case when the data line provides a first data signal at the first voltage level to the data signal port 500, if the gate line provides a first scan signal (at the first voltage level) to the scan signal port 400 and further to the first latch-control terminal LC1 and the second latch-control terminal LC2, the first switch transistor T1 is turned on and the second switch transistor T2 is turned off. The first data signal is written to the input terminal Q of the first inverter 110 while the input terminal Q is disconnected from the second output terminal O2. After inversion, voltage level at the output terminal AQ of the first inverter 110 is the second voltage level which is passed to the first control terminal C1 of the output sub-circuit 300. Thus, the first output transistor T5 is turned off with the first input terminal and the output terminal of the output sub-circuit 300 being disconnected. At the same time, the second voltage level inverted from the first data signal at the first output terminal AQ of the first inverter 110 is applied to the input terminal of the second inverter 120. After inversion, the voltage level at the second output terminal O2 of the second inverter 120 becomes the first voltage level which is passed to the second control terminal C2 of the output sub-circuit 300. This turns on the second output transistor T4 to make the second input terminal of the output sub-circuit 300 to connect with the output terminal of the output sub-circuit 300 so that the second reference voltage V_XFRP is outputted to the output terminal which is connected to the pixel electrode PE. Optionally, the second reference voltage V_XFRP is set to be the same as the first data signal at the first voltage level. The voltage difference between the pixel electrode PE and a common electrode COM induces an electric field, provided that the common electrode COM is at the second voltage level (or for example, at a ground level). This electrical field is able to drive deflections of liquid crystal molecules of the liquid crystal display panel.

When the gate line provides a second scan signal at the second voltage level (during the same cycle of displaying one frame of image) to the scan signal port 400 and further to the first latch-control terminal LC1 and the second latch-control terminal LC2, the first switch transistor T1 is turned off and the second switch transistor T2 is turned on. The first inverter 110 and the second inverter 120 of the latch sub-circuit 200 form an end-to-end closed latch loop. The first data signal at the first voltage level can be latched at the input terminal Q of the first inverter 110 which is connected via the second transistor T2 to the second control terminal C2 of the output sub-circuit 300. Therefore, the second input terminal of the output sub-circuit 300 is ensured to be connected with the output terminal of the output sub-circuit 300 to output a stable second reference voltage set at the first voltage level the same as the first data signal.

In case that the data line provides a second data signal at the second voltage level to the data signal port 500, when the gate line supplies a first scan signal at the first voltage level to the scan signal port 400 and further to both the first latch-control terminal LC1 and the second latch-control terminal LC2, the first switch transistor T1 is turned on and the second switch transistor T2 is turned off. The second data signal at the second voltage level from the data signal port 500 is written into the input terminal Q of the first inverter 110. After inversion, an output signal at the first output terminal AQ of the first inverter 110 becomes a voltage signal at the first voltage level which is passed to the first control terminal C1 of the output sub-circuit 300. The first voltage level at the first control terminal C1 turns on the first output transistor T5 to make the first input terminal of the output sub-circuit 300 to electrically connect with the output terminal of the output sub-circuit 300. Thus, a first reference voltage V_FRP (which can be set to be the same as the second data signal) provided to the first reference voltage port FRP can be outputted to the output terminal which connects to the pixel electrode PE. The voltage difference between the pixel electrode PE and the common electrode COM induces an electrical field between these two electrodes to drive deflections of the liquid crystal molecules. At the same time, the first inverter 110 also sends the output signal at the first voltage level to the input terminal of the second inverter 120. After inversion of the second inverter 120, the voltage level at the second output terminal O2 of the second inverter 120 is the second voltage level again which is applied to the second control terminal C2 of the output sub-circuit 300. The second voltage level at the second control terminal C2 turns off the second output transistor T4 to disconnect the second input terminal of the output sub-circuit 300 from the output terminal of the output sub-circuit 300.

When the gate line provides a second scan signal at the second voltage level to the scan signal port 400 and further to both the first latch-control terminal LC1 and the second latch-control terminal LC2, the first switch transistor T1 is turned off and the second switch transistor T2 is turned on. Then, the first inverter 110 is connected to the second inverter 120 end to end to form a closed latch loop and latch the second data signal at the second voltage level to the input terminal Q of the first inverter 110. Thus, the first control terminal of the output sub-circuit 300 is kept at the first voltage level to turn on the first output transistor to ensure the first input terminal to connect with the output terminal of the output sub-circuit 300 to output a stable voltage signal at the second voltage level from the first reference voltage port FRP.

Figure 2:
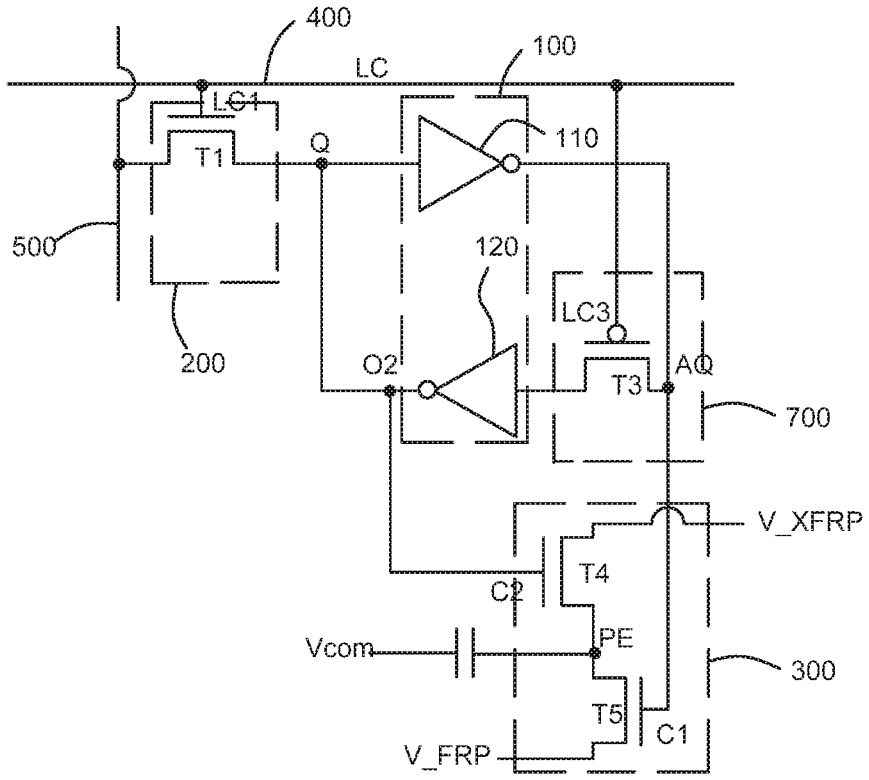
FIG. 2 is a circuitry structural diagram of a pixel circuit according to another embodiment of the present disclosure.

FIG. 2 is a circuitry structural diagram of a pixel circuit according to another embodiment of the present disclosure. As shown in FIG. 2, in the embodiment, the second latch-control sub-circuit 600 is configured in different way in the pixel circuit. The second latch-control sub-circuit 700 now includes a third switch transistor T3 coupled to the latch sub-circuit 100 in FIG. 2 differently than that shown in FIG. 1. The third switch transistor T3 includes a gate terminal coupled to a third latch-control terminal LC3 coupled to the scan signal port 400 commonly with the first latch-control terminal LC1. The third switch transistor T3 also includes a first terminal coupled to the first output terminal AQ of the first inverter 110 and a second terminal coupled to an input terminal of the second inverter. The third switch transistor is configured to connect the first terminal to the second terminal when the gate terminal receives the second scan signal at the second voltage level and to disconnect the first output terminal AQ of the first inverter 110 from the input terminal of the second inverter 120 to form an open circuit when the gate terminal receives the first scan signal at the first voltage level. The first switch transistor T1 in FIG. 2 is configured the same way as the one described in FIG. 1. In other words, when the third latch-control terminal LC3 provides a second scan signal at the second voltage level to the gate terminal of T3, it turns on T3 to connect the first terminal of T3 with the second terminal of T3 electrically have the first inverter 110 and the second inverter 120 to form a closed latch loop in the latch sub-circuit 100.

In the embodiment of FIG. 2, the output sub-circuit 300 is substantially the same as that shown in FIG. 1, including a first output transistor T5 and a second output transistor T4. In particular, the first control terminal C1 of the output sub-circuit 300 is coupled to the first output terminal of the first inverter 110 and the second control terminal C2 of the output sub-circuit 300 is coupled to the second output terminal O2 of the second inverter 120. A first terminal of the first output transistor T5 is coupled to a first reference voltage port FRP configured to be supplied with a first reference voltage V_FRP. A second terminal of the first output transistor T5 is coupled to the output terminal of the output sub-circuit 300 which is also connected to the pixel electrode PE. A first terminal of the second output transistor T4 is coupled to a second reference voltage port XFRP configured to be supplied with a second reference voltage V_XFRP. A second terminal of T4 is coupled to output terminal, i.e., the pixel electrode PE. Both the first output transistor T5 and the second output transistor T4 are selected to be a same P-type or N-type transistor as the first switch transistor T1.

Referring to FIG. 2, when the gate line provides a first scan signal to the scan signal port 400 and further to the first latch-control terminal LC1 and the third latch-control terminal LC3, the first switch transistor T1 of the first latch-control sub-circuit 200 is turned on and the third switch transistor T3 of the second latch-control sub-circuit 700 is turned off. The first inverter 110 and the second inverter 120 form an open circuit. When the gate line provides a second scan signal to the scan signal port 400 and further to the first latch-control terminal LC1 and the third latch-control terminal LC3, the third switch transistor T3 is turned on while the first switch transistor T1 is turned off so that the first inverter 110 connects the second inverter 120 end to end to form a closed latch loop.

Further, the output sub-circuit 300 in the pixel circuit shown in FIG. 2 is substantially the same as that shown in FIG. 1 except that the second control terminal C2 of the output sub-circuit 300 is directly connect to the second terminal of the first switch transistor T1 which is connected to the input terminal Q of the first inverter 110 and the second output terminal O2 of the second inverter 120 while the first control terminal C1 still is connected to the first output terminal AQ of the first inverter 110.

In case that the data line provides a first data signal at the first voltage level to the data signal port 500, when the gate line provides a first scan signal at the first voltage level to the scan signal port 400 and further to the first latch-control terminal LC1 and the third latch-control terminal LC3 in an initial portion of a cycle for displaying one frame of image, the first switch transistor T1 of the first latch-control sub-circuit 200 is turned on to allow the first data signal to be written to the input terminal Q of the first inverter 110 and the third switch T3 of the second latch-control sub-circuit 700 is turned off to form an open circuit in the latch sub-circuit 100. After inversion, the first voltage level at the input terminal Q of the first inverter 110 is inverted to the second voltage level outputted to the first output terminal AQ which is connected to the first control terminal C1 of the output sub-circuit 300. The second voltage level at the first control terminal C1 is able to turn off the first output transistor T5 to make the first input terminal of the output sub-circuit 300 to be disconnected from the output terminal of the output sub-circuit 300. At the same time, the first data signal at the first voltage level from the data signal port 500 is also directly written to the second output terminal of the second inverter 120 which is connected to the second control terminal C2 of the output sub-circuit 300. The first voltage level at the second control terminal C2 is able to turn on the second output transistor T4 to make the second input terminal of the output sub-circuit 300 to electrically connect with the output terminal of the output sub-circuit 300. Thus, a second reference voltage V_XFRP provided from the second reference voltage port XFRP is applied to the pixel electrode PE. The second voltage V_XFRP optionally is set to the same voltage level as the first data signal at the first voltage level and is able to induce an electrical field between the pixel electrode PE and the common electrode COM for driving deflections of liquid crystal molecules.

When the gate line provides a second scan signal at the second voltage level, in remain portion of a cycle, to the scan signal port 400 and further to the first latch-control terminal LC1 and the third latch-control terminal LC3, the first switch transistor T1 of the first latch-control sub-circuit 200 is turned off and the third switch transistor T3 of the second latch-control sub-circuit 700 is turned on. At this time, the first inverter 110 and the second inverter 120 form a closed latch loop in the latch sub-circuit 100 to latch the first data signal at the first voltage level to input terminal Q which is connected to the second control terminal C2 of the output sub-circuit 300. The first voltage level at the second control terminal C2 is able to turn on the second output transistor T4 so as to ensure the second input terminal of the output sub-circuit 300 to connect with the output terminal of the output sub-circuit 300, thereby outputting a stable first voltage level via the second reference voltage V_XFRP supplied to the second reference voltage port XFRP.

In case that the data line provides a second data signal at the second voltage level to the data signal port 500, when the gate line provides a first scan signal at the first voltage level to the scan signal port 400 and further to the first latch-control terminal LC1 and the third latch-control terminal LC3 in an initial portion of a cycle for displaying one frame of image, the first switch transistor T1 of the first latch-control sub-circuit 200 is turned on and the third switch transistor T3 of the second latch-control sub-circuit 700 is turned off. The second data signal at the second voltage level is written through T1 into the input terminal Q of the first inverter 110. After inversion by the first inverter 110, an output signal at the first voltage level is outputted to the first output terminal AQ of the first inverter 110 which is connected to the first control terminal C1 of the output sub-circuit 300. Thus, the first voltage level at the first control terminal C1 is able to turn on the first output transistor T5 so that the input terminal of the output sub-circuit 300 is electrically connected to the output terminal of the output sub-circuit 300 to pass the first reference voltage V_FRP from the first reference voltage port FRP to the pixel electrode PE. The first reference voltage V_FRP induces an electrical field between the pixel electrode PE and the common electrode COM for driving deflections of liquid crystal molecules in the display panel for displaying image.

At the same time during a cycle of displaying one frame of image, the second data signal at the second voltage level provided from the data line is outputted to the second control terminal C2 of the output sub-circuit 300. The second voltage level at the second control terminal C2 makes the second output transistor in a blocking state so that the second input terminal of the output sub-circuit 300 is disconnected from the output terminal of the output sub-circuit 300. When the gate line provides a second scan signal at the second voltage level to the scan signal port 400 and further to the first latch-control terminal LC1 and the third latch-control terminal LC3, the first switch transistor T1 of the first latch-control sub-circuit 200 is turned off and the third switch transistor T3 in the second latch-control sub-circuit 600 is turned on. The first inverter 110 and the second inverter 120 form a closed latch loop in the latch sub-circuit 100 so that the first voltage level at the first output terminal AQ, which is inverted from the second voltage level at the input terminal Q, is latched at the first control terminal C1 of the output sub-circuit 300. The first voltage level at the first control terminal C1 makes the first output transistor T5 a conductor to ensure that the first input terminal is electrically connected to the output terminal thereof to allow the output sub-circuit 300 to output a stable second data signal at the second voltage level supplied from the first reference port FRP.

Figure 3:
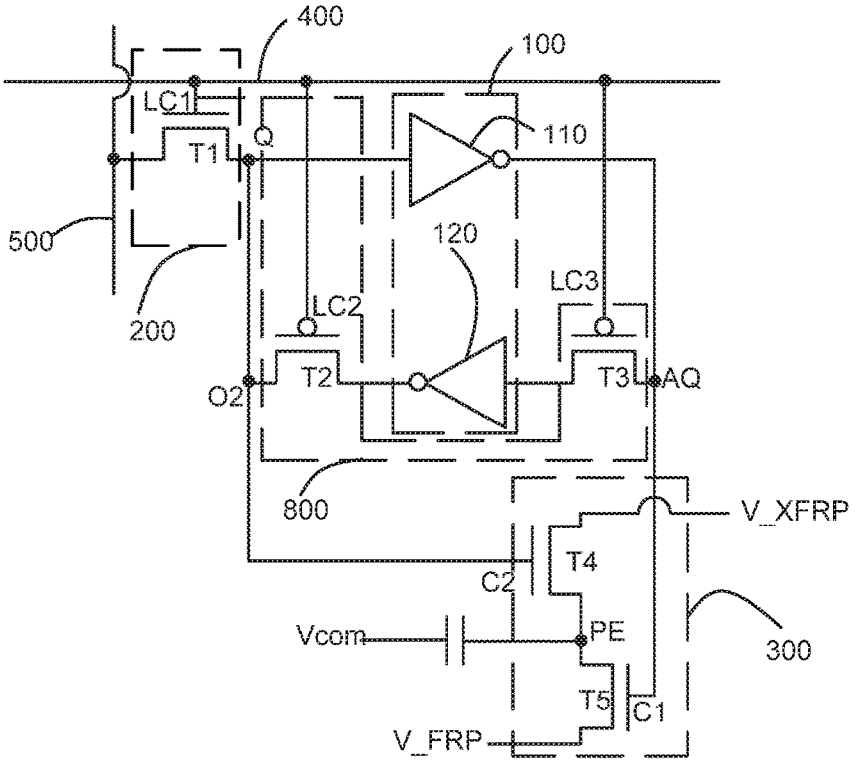
FIG. 3 is a circuitry structural diagram of a pixel circuit according to yet another embodiment of the present disclosure.

FIG. 3 shows yet another embodiment of the pixel circuit according to the present disclosure. Referring to FIG. 3, the first latch-control sub-circuit 200 includes a first switch transistor T1 and the second latch-control sub-circuit 800 includes a second switch transistor T2 and a third switch transistor T3. The first switch transistor T1 is substantially configured the same way as the one shown in FIG. 1 and FIG. 2. The second switch transistor T2 and the third switch transistor T3 are configured to have their respective gate terminals commonly coupled to a second latch-control terminal LC2 and a third latch-control terminal LC3 which are commonly connected to the scan signal port 400 shared with the first latch-control terminal LC1. The second switch transistor T2 also includes a first terminal coupled to the second terminal of the first switch transistor T1 which is coupled to the input terminal Q of the first inverter 110. The second switch transistor T2 further includes a second terminal coupled to the second output terminal O2 of the second inverter 120. The third switch transistor T3 includes a first terminal coupled to the first output terminal AQ of the first inverter 110 and a second terminal coupled to the input terminal of the second inverter 120. The latch sub-circuit 100 of the pixel circuit still is comprised of the first inverter 100 and the second inverter 120. The output sub-circuit 300 of the pixel circuit is substantially the same as that shown in FIG. 2 described above, including a first output transistor T5 and a second output transistor T4 respectively with a first control terminal C1 coupled to the output terminal AQ of the first inverter 110 and a second control terminal C2 coupled to the input terminal Q of the first inverter 110. Additionally, a first terminal of the first output transistor T5 is coupled to a first reference voltage port FRP configured to be supplied with a first reference voltage V_FRP. A second terminal of the first output transistor T5 is coupled to the output terminal of the output sub-circuit 300 which is also connected to the pixel electrode PE. A first terminal of the second output transistor T4 is coupled to a second reference voltage port XFRP configured to be supplied with a second reference voltage V_XFRP. A second terminal of T4 is coupled to the output terminal which is the pixel electrode PE. Both the first output transistor T5 and the second output transistor T4 are selected to be a same P-type or N-type transistor as the first switch transistor T1.

In the embodiment, the second switch transistor T2 and the third switch transistor T3 is set to be a same type of transistor, either a P-type transistor or an N-type transistor. For example, the second switch transistor T2 in P-type is turned off when the gate terminal coupled to the second latch-control terminal LC2 receives a first scan signal at the first voltage level from the scan signal port 400 and is turned on when the gate terminal receives a second scan signal at the second voltage level. Similarly, the third switch transistor T3 in P-type is turned off when the gate terminal receives a first scan signal at the first voltage level and is turned on when the gate terminal receives a second scan signal at the second voltage level.

For the pixel circuit of FIG. 3, in case that the data line provides a first data signal at the first voltage level to the data signal port 500, when the gate line provides a first scan signal at the first voltage level to the scan signal port 400 commonly coupled to the first, second, and third latch-control terminals LC1. LC2, and LC3, the first switch transistor T1 of the first latch-control sub-circuit 200 is turned on, the second switch transistor T2 and the third switch transistor T3 of the second latch-control sub-circuit 800 are turned off. The first data signal at the first voltage level is written to the input terminal Q of the first inverter 110. After inversion, the first inverter 110 outputs a voltage signal at the second voltage level to the first output terminal AQ which is connected to the first control terminal C1 of the output sub-circuit 300. The second voltage level at the first control terminal C1 makes the first output transistor T5 in a blocking state so that the first input terminal of the output sub-circuit 300 is disconnected from the output terminal of the output sub-circuit 300. At the same time, the first data signal at the first voltage level is passed through the first switch transistor T1 and applied to the second control terminal C2 of the output sub-circuit 300. The first voltage level at the second control terminal C2 makes the second output transistor T4 a conductor so that the second input terminal is connected with the output terminal of the output sub-circuit 300. Thus, a second reference voltage V_XFRP supplied from the second reference voltage port XFRP can be applied from the second input terminal to the output terminal which is connected to the pixel electrode PE. This second reference voltage V_XFRP is optionally set as the same as the first data signal and is able to induce an electrical field between the pixel electrode PE and the common electrode COM for driving deflections of the liquid crystal molecules in the display panel during a cycle of displaying a frame of image.

When the gate line provides a second scan signal at the second voltage level to the scan signal port 400 and further to three latch-control terminals LC1, LC2, and LC3, the first switch transistor T1 of the first latch-control sub-circuit 200 is turned off, the second switch transistor T2 and the third switch transistor T3 of the second latch-control sub-circuit 800 are turned on. The first inverter 110 and the second inverter 120 are connected to each other end to end to form a closed latch loop in the latch sub-circuit 100. The first voltage level of the first data signal is thus latched at the input terminal Q of the latch sub-circuit 100 which is connected to the second control terminal C2 of the output sub-circuit 300. The first voltage level at the second control terminal C2 makes the second output transistor T4 a conductor so that the second input terminal is maintained connection with the output terminal of the output sub-circuit 300 to stably output a first data signal (provided by the second reference voltage port).

In case that the data line provides a second data signal at the second voltage level to the data signal port 500, when the gate line provides a first scan signal at the first voltage level to the scan signal port 400 and three latch-control terminals LC1, LC2, and LC3, the first switch transistor T1 is turned on to write the second voltage level to the input terminal Q of the first inverter 110, the second switch transistor T2 and the third switch transistor T3 are turned off to form an open circuit in the latch sub-circuit 100. After inversion of the first inverter 100, an output signal at the first voltage level is outputted at the first output terminal AQ of the first inverter 100 and is further passed to the first control terminal C1 of the output sub-circuit 300. The first voltage level at the first control terminal C1 makes the first output transistor T5 a conductor so that the first input terminal of the output sub-circuit 300 is connected with the output terminal of the output sub-circuit 300 to allow the first reference voltage V_FRP to be written to the pixel electrode PE. The first reference voltage V_FRP is supplied from the first reference voltage port FRP and optionally is set to be the same as the second data signal. The first reference voltage induces an electrical field between the pixel electrode PE and the common electrode COM (which is biased at Vcom) to drive deflections of liquid crystal molecules in the display panel during a cycle of displaying a frame of image. At the same time, the second data signal at the second voltage level provided from the data line is directly passed to the second control terminal C2 of the output sub-circuit 300 to make the second input terminal to disconnect with the output terminal of the output sub-circuit 300. When the gate line provides a second scan signal at the second voltage level, the first switch transistor T1 is turned off; the second switch transistor T2 and the third switch transistor T3 are turned on. The first inverter 110 and the second inverter 120 form a closed latch loop in the latch sub-circuit 100 to latch the second voltage level at the input terminal Q which is passed to the second control terminal C2 of the output sub-circuit 300 and latch a first voltage level at the first output terminal AQ which is passed to the first control terminal C1. The first voltage level at C1 makes the first input terminal of the output sub-circuit 300 to be connected with the output terminal of the output sub-circuit 300. Thus, the second data signal at the second voltage level provided through the first reference voltage port can be stably outputted to the pixel electrode PE within the cycle of displaying the frame of image without need any scan signal refreshing.

In general for the embodiments shown in FIG. 1, FIG. 2, and FIG. 3, when the gate line provides a scan signal at the first voltage level to the scan signal port 400 commonly coupled to two or more latch-control terminals, the first inverter 100 and the second inverter 120 of the latch sub-circuit 100 form an open circuit so as to eliminate node voltage challenge or competition to make the output signal of the latch sub-circuit 100 to be independent of the driving ability of the first switch transistor T1. Optionally, in embodiments shown in FIG. 1 through FIG. 3, the first voltage level is a high voltage level configured to be a switch-on voltage for N-type transistor and the second voltage level is a low voltage level configured to be a switch-on voltage for P-type transistor. The first switch transistor T1, the first output transistor T5, and the second output transistor T4 are provided as the same N-type transistors. The second switch transistor T2 and the third switch transistor T3 are provided as P-type transistors. Alternatively, the first voltage level is a low voltage level configured to be a switch-on voltage for P-type transistor and the second voltage level is a high voltage level configured to be a switch-on voltage for N-type transistor. The first switch transistor T1, the first output transistor T5, and the second output transistor T4 are P-type transistors. The second switch transistor T2 and the third switch transistor T3 are N-type transistors.

In another aspect, the present disclosure provides a display panel, in particular, a liquid crystal display panel or a display panel that needs driving electrical field to change transitivity for passing light from a backend light source. The display panel includes multiple gate lines 400 and multiple data lines 500 crossing over each other to define multiple subpixels respectively associated with multiple pixel circuits described herein. Each pixel circuit includes a scan signal port coupled to a corresponding gate line and a data signal port coupled to a corresponding data line.

In the display panel, when a gate line associated with a pixel circuit of a subpixel is provided with a first scan signal at the first voltage level (or a switch-on voltage level for a first switch transistor), the latch sub-circuit therein is able to control the output sub-circuit therein to output a signal the same as the data signal provided from the data line associated with the pixel circuit. When the gate line is provided with a second scan signal at the second voltage level, the latch sub-circuit therein forms a closed latch loop to latch the data signal provided from the data line and control the output sub-circuit therein to output a signal the same as the data signal. Therefore, during the cycle of display one frame of image, there is no need to refresh scan signal of the display panel, thereby achieving power consumption reduction. Additionally, when the gate line is provided with a first scan signal at the first voltage level, the latch sub-circuit includes an open circuit to prevent node voltage competition and achieve a stable output.

In yet another aspect, the present disclosure provides a display apparatus including the display panel described herein.

In still another aspect, the present disclosure provides a method of driving the display panel described herein to display one or more frames of images in each or multiple cycles. During each cycle, the method includes sequentially providing a first scan signal to each of the multiple gate lines of the display panel. Each of the multiple gate lines is configured to receive the first scan signal for a number of times that is smaller than a preset number. The method further includes providing a second scan signal when the each of the multiple gate lines does not receive the first scan signal during the cycle. Additionally, the method includes providing data signals respectively to the multiple data lines.

As described above, the pixel circuit in the display panel is configured to have a latch sub-circuit capable of latching a data signal inputted to the pixel electrode when the first scan signal at the first voltage level (or a switch-on voltage level for at least the first switch transistor) is provided so that a preset number of scans (or scan signal refreshing) during each cycle for displaying one frame of image can be reduced to achieve reduction of power consumption of the display panel. Additionally, the pixel circuit eliminates node voltage competition associated with the latch sub-circuit so as to achieve stable signal output. Optionally, the preset number of scans can be 3, or other arbitrary numbers. Optionally, during each cycle of the display panel to display one frame of image, each gate line only receives a scan signal once, so that the reduction of the power consumption of the display panel is maximized.

Figure 4:
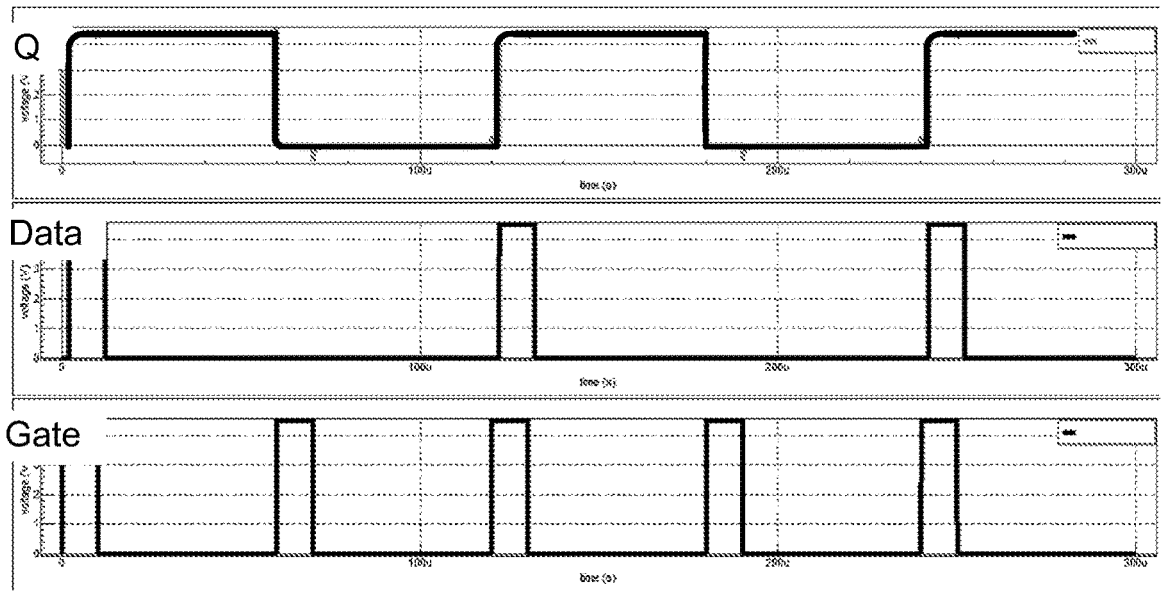
FIG. 4 is a simulation signal diagram of a signal at the input terminal of a latch sub-circuit, a data signal, and a scan signal of the pixel circuit of FIG. 1 according to an embodiment of the present disclosure.

FIG. 4 is a simulation signal diagram of signals at the input terminal Q of the first inverter of the latch sub-circuit, data signals, and scan signals in a pixel circuit according to some embodiments of the present disclosure. In particular, Data represents data signals provided through the data signal port of the pixel circuit. Gate represents scan signals provided through the scan signal port of the pixel circuit. In an example, referring to FIG. 4, the voltage at the input terminal Q of the latch sub-circuit is kept stable no matter what is the driving power of the first switch transistor T1.

Figure 5:
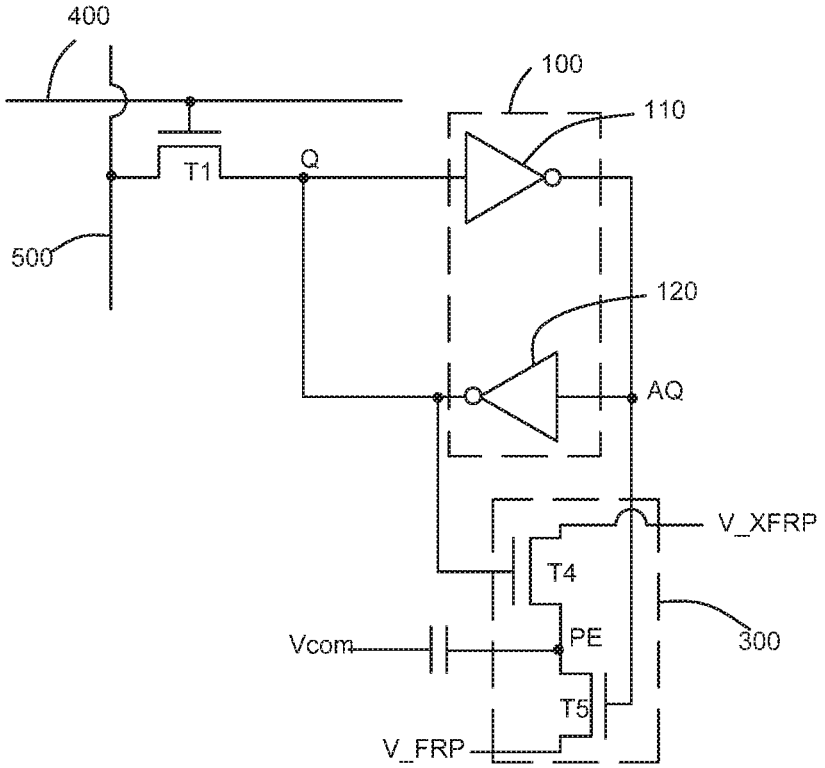
FIG. 5 (related art)
FIG. 5 is a circuitry structural diagram of a conventional pixel circuit.

FIG. 5 is a circuitry structural diagram of a conventional pixel circuit. Unlike the embodiment shown in FIG. 1, the latch sub-circuit in the conventional pixel circuit only includes a configuration with the first inverter 110 and the second inverter 120 being in a closed latch loop.

Figure 6:
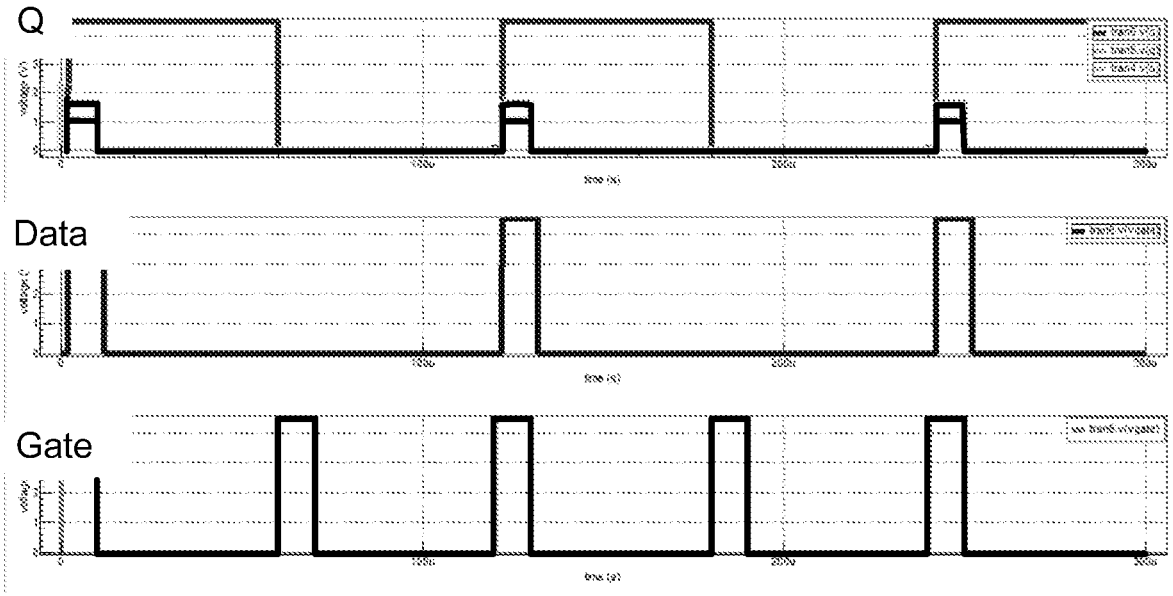
FIG. 6 (related art)
FIG. 6 is a simulation diagram of a signal at the input terminal of a latch sub-circuit, a data signal, and a scan signal of the conventional pixel circuit of FIG. 5.

FIG. 6 is a simulation signal diagram of signals at the input terminal Q of the first inverter of the latch sub-circuit, data signals, and scan signals in the conventional pixel circuit of FIG. 5. Data represents data signals provided through the data signal port of the pixel circuit. Gate represents scan signals provided through the scan signal port of the pixel circuit. As shown in FIG. 6, when the first switch transistor T1 is driven by different scan signals, the latch sub-circuit therein suffers unstable signal output due to node voltage competition.

Optionally, the common electrode COM is configured to be biased at Vcom which can be used to achieve polarity inversion of the display panel.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel circuit comprising:

a first latch-control sub-circuit comprising a first latch-control terminal coupled to a scan signal port and an input terminal coupled to a data signal port, and being configured to output a data signal when the scan signal port receives a first scan signal at a first voltage level;

a latch sub-circuit coupled to the first latch-control sub-circuit, and comprising a first inverter and a second inverter, the first inverter having an input terminal configured to receive the data signal and coupled to the second inverter to form a latch loop when the scan signal port receives a second scan signal at a second voltage level, each of the first inverter and the second inverter inverting the first voltage level to the second voltage level and vice versa;

a second latch-control sub-circuit coupled to the latch sub-circuit, the second latch-control sub-circuit comprising a second latch-control terminal, and being configured to control that the second inverter and the first inverter form an open circuit when the scan signal port receive the first scan signal at the first voltage level; and an output sub-circuit comprising a first control terminal coupled to a first output terminal of the first inverter, a second control terminal coupled to a second output terminal of the second inverter, a first input terminal coupled to a first reference voltage port, a second input terminal coupled to a second reference voltage port, and an output terminal coupled to a pixel electrode, the output sub-circuit being configured to connect the output terminal with the first input terminal when the first control terminal is set to the first voltage level and connect the output terminal with the second input terminal when the second control terminal is set to the first voltage level;

wherein the first latch-control sub-circuit comprises a first switch transistor having a gate terminal coupled to the first latch-control terminal, a first terminal coupled to the data signal port, and a second terminal coupled to the input terminal of the first inverter, the first switch transistor being configured to connect the first terminal to the second terminal when the gate terminal receives the first scan signal at the first voltage level from the first latch-control terminal coupled to the scan signal port; and the second latch-control sub-circuit comprises a third switch transistor having a gate terminal coupled to a third latch-control terminal, a first terminal coupled to the first output terminal of the first inverter, and a second terminal coupled to an input terminal of the second inverter, the third switch transistor being configured to connect the first terminal to the second terminal when the gate terminal receives the second scan signal at the second voltage level from the third latch-control terminal.

2. The pixel circuit of claim 1, wherein the first voltage level of the first scan signal is a switch-on signal; and the first switch transistor is an N-type transistor if the first voltage level is a high voltage level or a P-type transistor if the first voltage level is a low voltage level.

3. The pixel circuit of claim 1, wherein the second latch-control sub-circuit comprises a second switch transistor having a gate terminal coupled to the second latch-control terminal, a first terminal coupled to the second terminal of the first switch transistor, and a second terminal coupled to the second output terminal of the second inverter, the second switch transistor being configured to connect the first terminal thereof to the second terminal thereof when the gate terminal thereof receives a second scan signal at the second voltage level from the second latch-control terminal.

4. The pixel circuit of claim 3, wherein the second latch-control terminal is coupled to the scan signal port shared with the first latch-control terminal, the second voltage level of the second scan signal is a switch-on signal for the second switch transistor but a switch-off signal for the first switch transistor.

5. The pixel circuit of claim 4, wherein the second switch transistor is a P-type transistor and the first switch transistor is an N-type transistor if the second voltage level is a low-voltage level or the second switch transistor is an N-type transistor and the first switch transistor is a P-type transistor if the second voltage level is a high voltage level.

6. The pixel circuit of claim 1, wherein the third latch-control terminal is coupled to the scan signal port shared with the first latch-control terminal, the second voltage level of the second scan signal is a switch-on signal for the third switch transistor but a switch-off signal for the first switch transistor.

7. The pixel circuit of claim 6, wherein the third switch transistor is, a P-type transistor if the second voltage level is a low-voltage level while the first voltage level is a high voltage level, or an N-type transistor if the second voltage level is a high voltage level while the first voltage level is a low voltage level.

8. A pixel circuit comprising:

a first latch-control sub-circuit comprising a first latch-control terminal coupled to a scan signal port and an input terminal coupled to a data signal port, and being configured to output a data signal when the scan signal port receives a first scan signal at a first voltage level;

a latch sub-circuit coupled to the first latch-control sub-circuit, and comprising a first inverter and a second inverter, the first inverter having an input terminal configured to receive the data signal and coupled to the second inverter to form a latch loop when the scan signal port receives a second scan signal at a second voltage level, each of the first inverter and the second inverter inverting the first voltage level to the second voltage level and vice versa;

a second latch-control sub-circuit coupled to the latch sub-circuit, the second latch-control sub-circuit comprising a second latch-control terminal, and being configured to control that the second inverter and the first inverter form an open circuit when the scan signal port receive the first scan signal at the first voltage level; and an output sub-circuit comprising a first control terminal coupled to a first output terminal of the first inverter, a second control terminal coupled to a second output terminal of the second inverter, a first input terminal coupled to a first reference voltage port, a second input terminal coupled to a second reference voltage port, and an output terminal coupled to a pixel electrode, the output sub-circuit being configured to connect the output terminal with the first input terminal when the first control terminal is set to the first voltage level and connect the output terminal with the second input terminal when the second control terminal is set to the first voltage level;

wherein the first latch-control sub-circuit comprises a first switch transistor having a gate terminal coupled to the first latch-control terminal, a first terminal coupled to the data signal port, and a second terminal coupled to the input terminal of the first inverter, the first switch transistor being configured to connect the first terminal to the second terminal when the gate terminal receives the first scan signal at the first voltage level from the first latch-control terminal coupled to the scan signal port; and the second latch-control sub-circuit comprises a second switch transistor and a third switch transistor, the second switch transistor including a gate terminal coupled to a second latch-control terminal, a first terminal connected to the second terminal of the first switch transistor, and a second terminal connected to the second output terminal of the second inverter;

the third switch transistor including a gate terminal also coupled to a third latch-control terminal, a first terminal connected to the first output terminal of the first inverter, and a second terminal connected to an input terminal of the second inverter.

9. The pixel circuit of claim 8, wherein the second latch-control terminal and the third latch-control terminal is commonly coupled to the scan signal port to receive the second scan signal at the second voltage level as a switch-on signal to turn on the second switch transistor for connecting the first terminal to the second terminal thereof and simultaneously turn on the third switch transistor for connecting the first terminal to the second terminal thereof to connect the first inverter end-to-end to the second inverter as a latch loop, or to receive the first scan signal at the first voltage level as a switch-off signal to turn off both the second switch transistor and the third switch transistor to have the first inverter and the second inverter forming an open circuit.

10. The pixel circuit of claim 8, wherein each of the second switch transistor and the third switch transistor is a P-type transistor while the first switch transistor is an N-type transistor if the second voltage level is a low voltage level corresponding to the first voltage level at a high voltage level; or each of the second switch transistor and the third switch transistor is an N-type transistor while the first switch transistor is a P-type transistor if the second voltage level is a high voltage level corresponding to the first voltage level at a low voltage level.

11. The pixel circuit of claim 1, wherein the output sub-circuit comprises a first output transistor and a second output transistor, the first output transistor including a first terminal coupled to the first input terminal received a first reference voltage from the reference voltage port, a second terminal coupled to the output terminal, and a gate terminal coupled to the first control terminal, and the second output transistor including a first terminal coupled to the second input terminal received a second reference voltage from the second reference voltage port, a second terminal coupled to the output terminal, and a gate terminal coupled to the second control terminal.

12. The pixel circuit of claim 11, wherein the first output transistor is configured to connect the first terminal to the second terminal thereof to output the first reference voltage to the output terminal when the first control terminal receives the first voltage level from the first output terminal of the first inverter; the second output transistor is configured to connect the first terminal to the second terminal thereof to output the second reference voltage to the output terminal when the second control terminal receives the first voltage level from the second output terminal of the second inverter.

13. The pixel circuit of claim 12, wherein each of the first output transistor and the second output transistor is the same type of transistor as the first switch transistor as the first voltage level is set to a switch-on signal for the first switch transistor and the second voltage level is a voltage level inverted by one of the first inverter and the second inverter from the first voltage level.

14. A display panel comprising multiple gate lines and multiple data lines interlaced over each other defining multiple subpixels, wherein each subpixel comprises a pixel circuit of claim 1 for providing driving electric field, the scan signal port of the pixel circuit being connected to corresponding one of the multiple gate lines and the data signal port being connected to corresponding one of the multiple data lines.

15. A display apparatus comprising a display panel of claim 14.

16. A method of driving a display panel, the method comprising:

providing driving electric field to a respective subpixel of the display panel through a pixel circuit;

connecting a scan signal port to a respective one of multiple gate lines;

connecting a data signal port to a respective one of multiple data lines;

coupling a first latch-control terminal of a first latch-control sub-circuit of the pixel circuit to the scan signal port, coupling an input terminal of the first latch-control sub-circuit to the data signal port, outputting a data signal by the first latch-control terminal when the scan signal port receives a first scan signal at a first voltage level;

coupling a latch sub-circuit to the first latch-control sub-circuit;

receiving the data signal by an input terminal of a first inverter of the latch sub-circuit;

coupling the input terminal of the first inverter to a second inverter to form a latch loop when the scan signal port receives a second scan signal at a second voltage level, each of the first inverter and the second inverter inverting the first voltage level to the second voltage level and vice versa;

coupling a second latch-control sub-circuit to the latch sub-circuit;

controlling, by the second latch-control sub-circuit, the second inverter and the first inverter to form an open circuit when the scan signal Dort receive the first scan signal at the first voltage level;

coupling a first control terminal of an output sub-circuit to a first output terminal of the first inverter, coupling a second control terminal of the output sub-circuit to a second output terminal of the second inverter, coupling a first input terminal of the output sub-circuit to a first reference voltage port, coupling a second input terminal of the output sub-circuit to a second reference voltage port, coupling an output terminal of the output sub-circuit to a pixel electrode;

connecting the output terminal of the output sub-circuit to the first input terminal when the first control terminal is set to the first voltage level;

connecting the output terminal of the output sub-circuit to the second input terminal when the second control terminal is set to the first voltage level;

coupling a gate terminal of a first switch transistor of the first latch-control sub-circuit to the first latch-control terminal, coupling a first terminal of the first switch transistor to the data signal port, coupling a second terminal of the first switch transistor to the input terminal of the first inverter;

connecting the first terminal of the first switch transistor to the second terminal of the first switch transistor when the gate terminal of the first switch transistor receives the first scan signal at the first voltage level from the first latch-control terminal coupled to the scan signal port;

coupling a gate terminal of a third switch transistor of the second latch-control sub-circuit to a third latch-control terminal, coupling a first terminal of the third switch transistor to the first output terminal of the first inverter, coupling a second terminal of the third switch transistor to an input terminal of the second inverter;

connecting the first terminal of the third switch transistor to the second terminal of the third switch transistor when the gate terminal of the third switch transistor receives the second scan signal at the second voltage level from the third latch-control terminal;

in each driving cycle, sequentially providing a first scan signal at a first voltage level to each of the multiple gate lines of the display panel, each of the multiple gate lines being configured to receive the first scan signal for a number of times that is smaller than a preset number of scans, and providing a second scan signal at a second voltage level when the each of the multiple gate lines does not receive the first scan signal; and providing data signals respectively to the multiple data lines.

17. The method of claim 16, wherein each of the multiple gate lines receives the first scan signal once in each driving cycle.

18. The method of claim 16, wherein the first voltage level is set as a high voltage configured to turn on an N-type transistor and the second voltage level is set as a low voltage configured to turn on a P-type transistor.

* * * * *